United States Patent [19]

Prewitt

[11] 4,017,915

[45] Apr. 19, 1977

[54] FOLDING BASIN

[76] Inventor: Era Pauline Prewitt, Rte. No. 1, Grandview, Tex. 76050

[22] Filed: Aug. 29, 1975

[21] Appl. No.: 609,098

[52] U.S. Cl. ..... 4/177 R

[51] Int. Cl.[2] ..... A47K 3/062

[58] Field of Search ..... 4/177, 185 B, 185 AB, 4/173, 182, 166, 167, 170, 187 R; 9/2 C, 2 F; 5/344

[56] References Cited

UNITED STATES PATENTS

| | | | |
|---|---|---|---|
| 1,011,114 | 12/1911 | Button | 4/177 |
| 1,190,266 | 7/1916 | Crooker | 4/177 |
| 1,472,877 | 11/1923 | Lichtenstein | 4/177 |
| 2,950,484 | 8/1960 | Jaffe | 4/177 |
| 3,631,544 | 1/1972 | Tytel | 4/17[illegible] |

FOREIGN PATENTS OR APPLICATIONS

| | | | |
|---|---|---|---|
| 389,447 | 9/1908 | France | 4/177 |
| 2,635 | 1866 | United Kingdom | 4/177 |

*Primary Examiner*—Harry N. Haroian
*Attorney, Agent, or Firm*—Clarence A. O'Brien; Harvey B. Jacobson

[57] ABSTRACT

A washbasin formed from a flexible sheet of material and rigidified by parallel spaced reinforcing elements, is held erect by corner flap hooks received in loops on the outside of adjacent side panels against which the corner flaps are folded. Spaced side panels are folded onto the bottom panel and then folded therewith into a compact form for storage purposes.

4 Claims, 5 Drawing Figures

FOLDING BASIN

This invention relates to a flexible and foldable type of washbasin or receptacle.

Flexible types of washbasins are well known. However, such prior washbasins have not been constructed so as to be suitably foldable into compact form with the ease of the present invention nor made of a comparable economical construction. Examples of the prior art known to the inventor are disclosed in U.S. Pat. Nos. 185,372, 1,016,114, 1,190,266, 1,931,146 and 3,187,350.

In accordance with the present invention, a foldable washbasin or receptacle particularly suited for the bathing of babies, is formed from a flexible sheet of material that is rigidified by parallel spaced reinforcing elements separately secured to a bottom panel of the sheet and to side panels bordering the bottom panel. In the embodiment disclosed, the bottom panel and side panels form a substantially rectangular basin with the side panels being interconnected by corner flaps adapted to be folded against the outside of the side panels when the basin is erected. Hook formations extending from the corner flaps are adapted to engage loops secured to the side panels in order to hold the basin erect. The basin is folded into compact form by first laying the sheet of material out flat and folding two of these side panels which extend perpendicular to the parallel spaced reinforcing elements onto the bottom panel after which the bottom panel with the side panels folded thereon are folded along foldlines parallel to the rigidifying elements into the compact form, for storage purposes. The folded basin is held in its compact form by a fastener strap.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
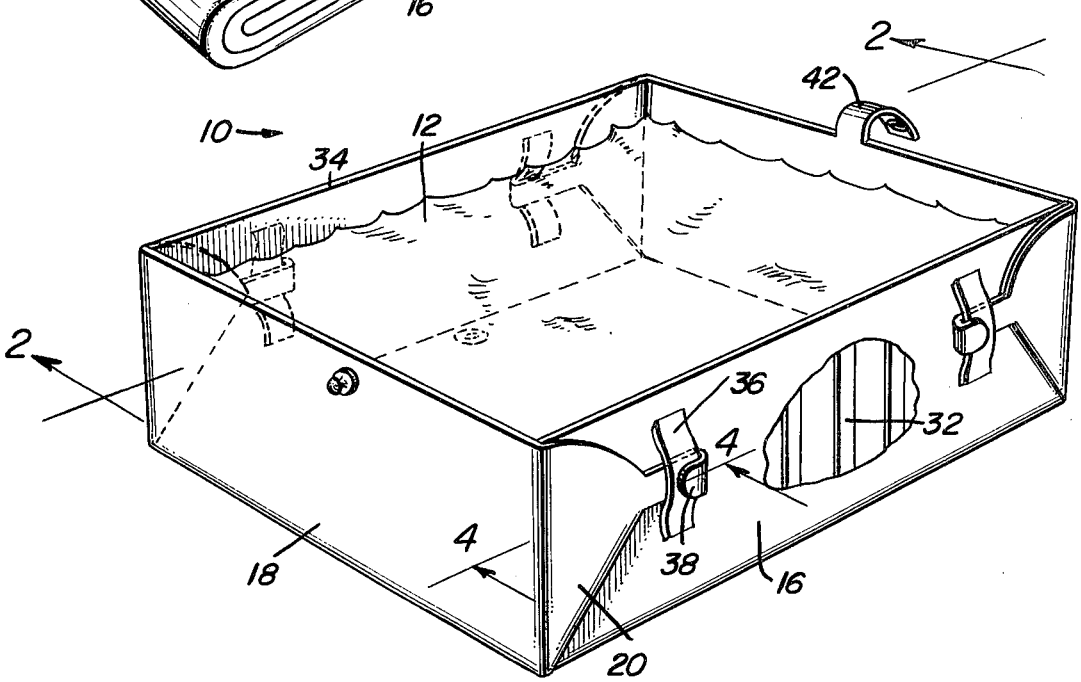
FIG. 1 is a perspective view showing a washbasin constructed in accordance with the present invention in an erect condition containing a body of water.
Figure 2:
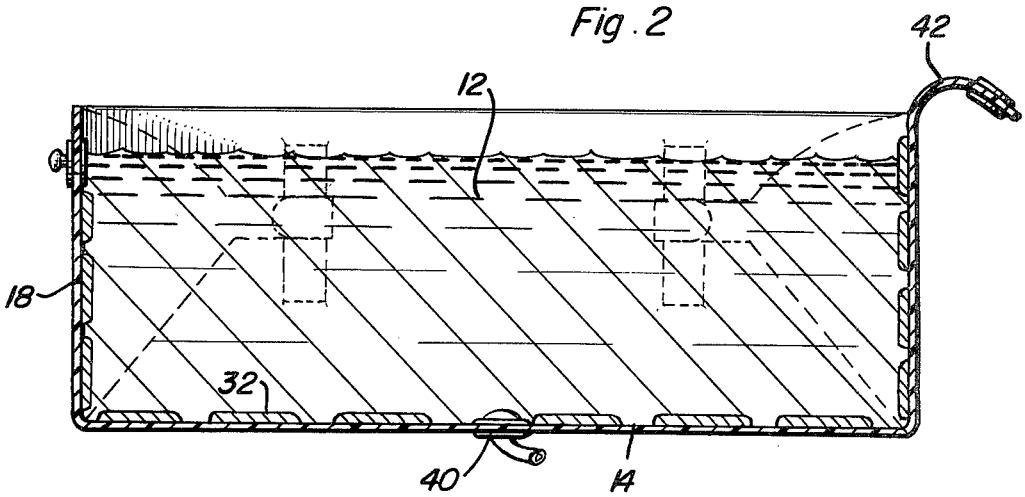
FIG. 2 is a sectional view taken substantially through a plane indicated by section line 2—2 in FIG. 1.
Figure 3:
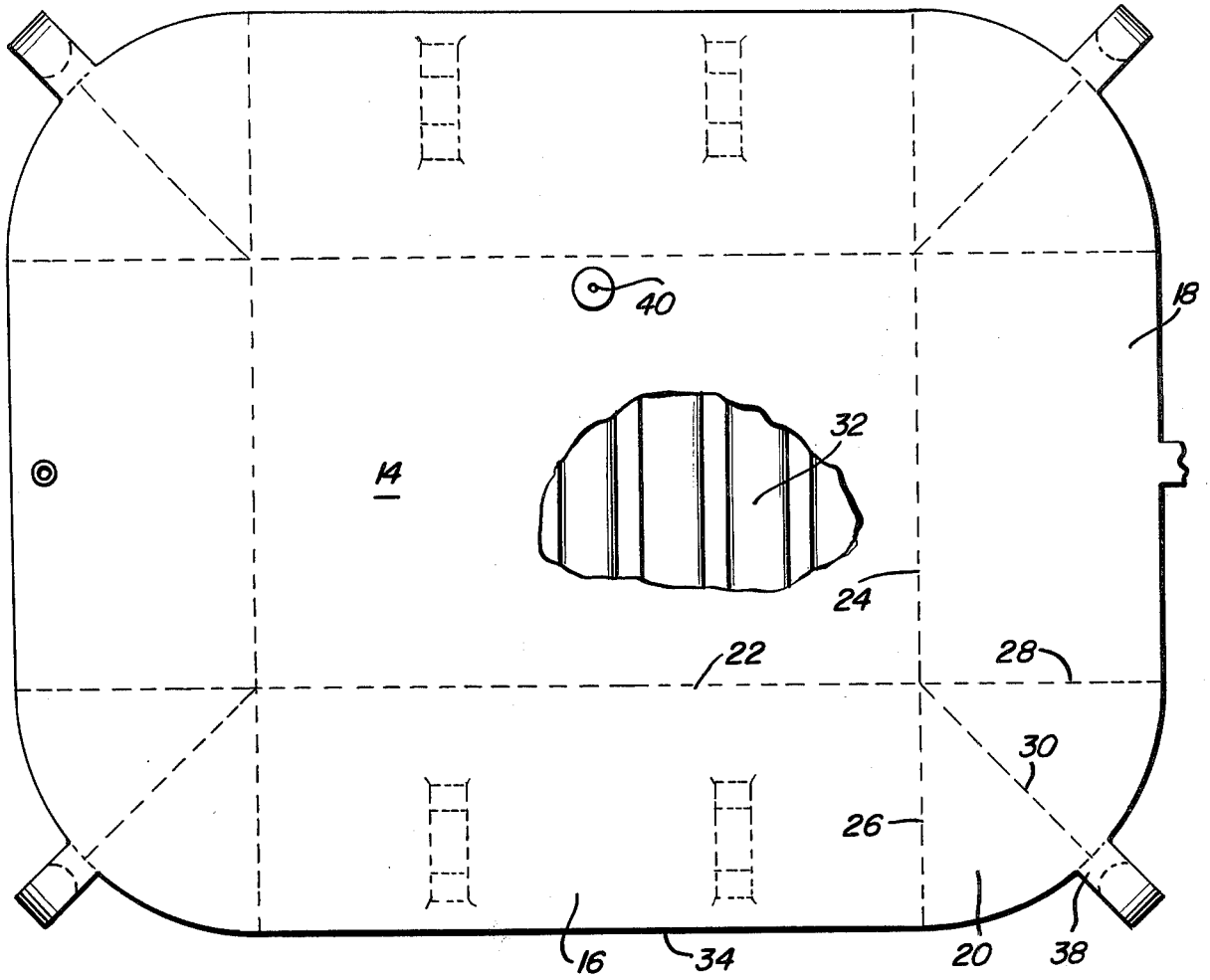
FIG. 3 is a top plan view of the washbasin laid out in flat form.
Figure 4:
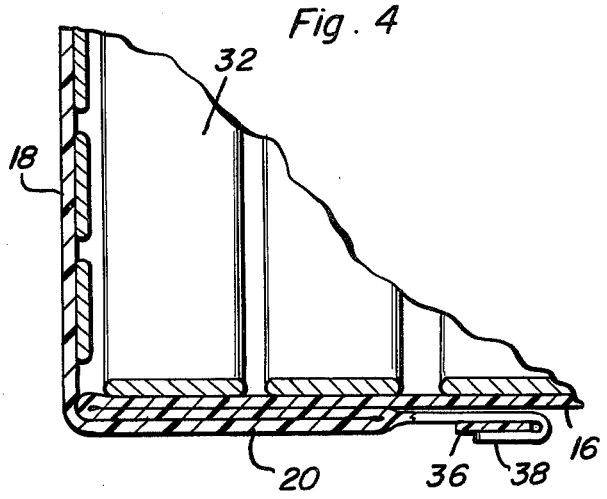
FIG. 4 is an enlarged partial sectional view taken substantially through a plane indicated by section line 4—4 in FIG. 1.

Referring now to the drawings in detail, FIG. 1 illustrates the erected washbasin of the present invention generally denoted by reference numeral 10. As shown in FIGS. 1 and 2, the erected washbasin is adapted to retain a body of water 12 and in the illustrated embodiment is of generally rectangular shape. The basin is formed from a single flexible sheet of material as more clearly seen in FIG. 3 which includes a generally rectangular bottom panel portion 14 interconnected with parallel spaced side panel portions 16 and parallel spaced side panel portions 18. Adjacent side panels 16 and 18 are interconnected by corner flap portions 20. The sheet of flexible material is folded along parallel spaced foldlines 22 and parallel spaced foldlines 24 perpendicular thereto, the latter foldlines defining the bottom panel. The corners of the erected basin as shown in FIG. 1, are formed by the foldlines 26 and 28 between which the corner flaps 20 are defined. Each corner flap itself is folded along an intermediate foldline 30 so that it may be folded against one of the side panel portions 16.

Reinforcing slat elements 32 are secured to the sheet material of the basin on the inside to rigidify the same. The reinforcing elements are bonded to the flexible material in parallel spaced relationship to each other. The reinforcing elements terminate at opposite ends adjacent the foldlines 22 on the bottom panel portions while separate reinforcing elements extend between the foldlines 22 and the outer or upper edges 34 transverse to the length of the side panels 16 but parallel to the side panels 18 between the foldlines 28. Thus, the bottom panel and the side panels are separately rigified by the reinforcing elements.

Secured to each of the side panel portions 16 are a pair of loops 36 adapted to receive hook formations 38 projecting from the corner flap portions 20. When the hook formations 38 are engaged with the loops 36 as shown in FIG. 1, the washbasin will be held in its erect condition by holding the folded flap portion 20 against the side panels 16.

Figure 5:
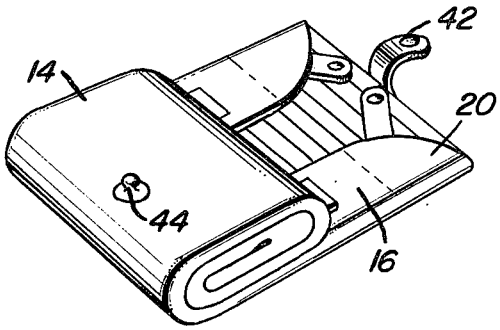
FIG. 5 is a perspective view showing the washbasin in substantially folded compact condition.

The washbasin may be folded into a compact form after the water 12 is drained therefrom through a plug-type drain fitting 40 located in the bottom panel portion 14. To fold the emptied washbasin, the side panels 16 and corner flaps 20 are folded along the foldlines 22 and 28 onto the bottom panel and side panels 18 maintained on a flat surface. The bottom panel with the side panels thereon may then be folded along foldlines parallel to and between the rigidifying elements 32 as shown in FIG. 5. The formation of a plurality of foldlines between the elements 32 enables folding of the basin into a very compact form. A fastener tab 42 projecting from one of the side panels 18, may then be fastened to the bottom of the bottom panel by means of a snap 44 as shown in FIG. 5 in order to hold the folded basin in its compact form for storage purposes.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A foldable liquid retaining basin comprising a sheet of liquid impervious flexible material having a bottom panel portion bordered by peripheral side panel portion interconnected by foldable flap portions, said side panel portions being connected along folds to the bottom panel portion and foldable to erect positions relative to the bottom panel portions, a plurality of parallel spaced rigidifying slat elements secured to each of the bottom and side panel portions forming a plurality of foldlines therebetween, two of the side panel portions spaced from each other and extending transversely of the rigidifying elements when folded onto the bottom panel portion being foldable with the bottom panel portion along said foldlines into a compact form, the slat elements secured to said two of the side panel portions and the bottom panel portion, respectively, being separated from each other along the folds between said two of the side panel portions and the bottom panel portion, and fastener means for holding the side panel portions in said erect positions with the rigidifying elements on said two of the side panel portions being in substantially perpendicular relation to the rigidifying elements on the bottom panel portion and the other of the side panel portions.

2. The combination of claim 1 including a fastener tab projecting from one of the side panel portions extending parallel to the rigidifying elements for holding the basin folded in said compact form.

3. The combination of claim 2 wherein said fastener means includes a loop secured to the adjacent ones of the side panel portions and a hook formation projecting from the corner flap portions adapted to be received in the loop.

4. The combination of claim 1 wherein said fastener means includes a loop secured to the adjacent ones of the side panel portions and a hook formation projecting from the corner flap portions adapted to be received in the loop.

* * * * *